US006461068B1

(12) United States Patent
Holmes

(10) Patent No.: US 6,461,068 B1
(45) Date of Patent: Oct. 8, 2002

(54) CORRECTION TAPE EQUIPPED WRITING INSTRUMENTS

(76) Inventor: Robert Holmes, 515 Forrest La., Corsicana, TX (US) 75110

( * ) Notice: Subject to any disclaimer, the term of this patent is extended or adjusted under 35 U.S.C. 154(b) by 0 days.

(21) Appl. No.: 09/875,554

(22) Filed: Jun. 7, 2001

(51) Int. Cl.[7] ..... B05C 1/00
(52) U.S. Cl. ..... 401/17; 401/195
(58) Field of Search ..... 401/17, 18, 52, 401/195, 21

(56) References Cited

U.S. PATENT DOCUMENTS

| | | | | | |
|---|---|---|---|---|---|
| 2,481,803 | A | * | 9/1949 | Weaver | 152/231 |
| 4,228,028 | A | * | 10/1980 | Lin | 252/188.3 |
| 4,511,273 | A | | 4/1985 | Trotta | 401/260 |
| 4,557,618 | A | * | 12/1985 | Iwata et al. | 401/34 |
| 4,572,691 | A | | 2/1986 | Kirchoff et al. | 401/214 |
| 4,600,327 | A | | 7/1986 | Guzman | 401/18 |
| 4,812,071 | A | | 3/1989 | Batra | 401/264 |
| 4,917,521 | A | | 4/1990 | Lai | 401/260 |
| 4,923,317 | A | | 5/1990 | Bishop et al. | 40/205 |
| 4,979,840 | A | * | 12/1990 | Madaus et al. | 401/202 |
| D319,469 | S | | 8/1991 | Rutter | D19/53 |
| 5,056,949 | A | | 10/1991 | Petrillo | 401/214 |
| 5,123,766 | A | | 6/1992 | Babiak | 401/180 |
| 5,261,755 | A | | 11/1993 | Draper et al. | 401/264 |
| 5,310,437 | A | | 5/1994 | Tucker | 156/238 |
| 5,338,123 | A | | 8/1994 | Obersteller et al. | 401/34 |
| 5,393,368 | A | | 2/1995 | Stevens | 156/577 |
| 5,714,035 | A | | 2/1998 | Stevens | 156/577 |
| 5,746,529 | A | | 5/1998 | Peters et al. | 401/18 |
| 5,792,263 | A | * | 8/1998 | Koyama et al. | 118/257 |
| 5,820,728 | A | | 10/1998 | Stevens et al. | 156/577 |
| 5,915,872 | A | | 6/1999 | Machida et al. | 401/251 |
| 6,112,796 | A | | 9/2000 | Stevens | 156/577 |
| 6,179,501 | B1 | * | 1/2001 | Fulop | 401/34 |
| 6,273,582 | B1 | * | 8/2001 | Taggart et al. | 362/119 |

* cited by examiner

*Primary Examiner*—David J. Walczak
*Assistant Examiner*—Huyen Le
(74) *Attorney, Agent, or Firm*—Christopher J. Whewell

(57) ABSTRACT

Provided herein are writing instruments which include a first end portion from which characters may be dispensed, such as an inkpen tip, and a second end portion comprising a correction tape dispensing means. Through use of the present invention, a writer who makes an error using an ink may conveniently invert the writing instrument from an initial position having the inkpen in contact with the paper being written upon, to a second position in which the correction tape dispensing means is in contact with the paper. Such a 180 degree change in the position of the writing instrument is all that is needed to render the writer able to apply a sufficient portion of correction tape to an error in the process for its correction. Through use of the present invention, convenience is increased, while exposure of the writer to harmful volatile chemicals as in the cases when a correction fluid containing a volatile organic compound, such as a halogenated hydrocarbon, is used.

13 Claims, 1 Drawing Sheet

CORRECTION TAPE EQUIPPED WRITING INSTRUMENTS

TECHNICAL FIELD

This invention relates to the field of utensils and instruments useful for writing, including inkpens and the like. More particularly, it relates to writing instruments having a linear construction with a first and second end portion, wherein the first end portion is provided with a means for dispensing ink during a normal writing process, and the second end portion is provided with a correction tape dispensing provision.

BACKGROUND

Since the earliest of times when people began writing characters on substrates such as parchments, paper, and the like using various media as part of a written recordation system, persons making such written records or writings have inadvertently made errors in linguistical, numerical, and various other characters put down. In those cases where pencils and other means for applying written characters to a substrate are used that are easily erasable, a writer possessing a pencil that is equipped with an eraser on the non-writing end has the convenient luxury of making a quick erasure of a misplaced or incorrect character, and continuing on in the writing process, as is wellknown. However, it is generally true in the art that those particular media which lend themselves well to erasure, such as pencil graphite writings and certain so-called "erasable inks" do not have the permanency over time as do their more indelible counterparts, such as inks and other similar compositions. Thus, in many cases, and particularly those for which written records are desired to be maintained in legible form or extended periods of time, as in the case of legal documents, the use of non-erasable inks is highly desirable. Owing to human nature, however, it is inescapable that mistakes or other errors in entry of characters into ledgers et cet., will be made from time to time by persons using inks and the like, and means for correcting mistakes will always find a place among the writers supply list.

The prior art is replete with many means for assisting a writer with correcting errors made when using a relatively indelible substance such as an ink. One such means is a specially prepared paper which is erasable, such as Corrosible Bond® typing paper, that found widespread acceptance by typists beginning in the 1970's because the chemical nature of the surface of the paper enabled the typist to erase an erroneous typewritten character using an ordinary pencil eraser.

Another means for assisting a writer with correcting errors made when using a relatively indelible substance such as an ink is the use of what has become widely recognized in the art as "correction fluid". Correction fluid is essentially a white paint substance which comprises a volatile solvent as the vehicle, which solvent is typically a halogenated hydrocarbon such as methylene chloride, etc., to enable the composition to be fast-drying to the user. In practice, the writer who has made an error typically unscrews the cap of a bottle containing the correction fluid, which cap is equipped with a brush means that is in contact with the liquid composition inside the bottle when the cap is in a closed position. The correction fluid which adheres to the brush upon its removal from the bottle is typically the needed quantity to correct most errors, and the user essentially "paints" over the mistake with the composition.

The prior art patent literature is replete with various contrivances associated with the use of correction fluid, the following examples being but a few: U.S. Pat. No. 4,511,273 teaches a correction fluid dispenser comprising a body member adapted to retain correction fluid, a barrel member received by the body member, a core portion extending axially of the body and barrel members, and a tip seal member disposed in a recess in the core portion and spring biased toward an orifice in the barrel member to block the orifice and prevent flow of fluid therethrough, the tip seal member being retractable against the spring bias to permit fluid flow through the orifice, the body and barrel members being operable to move the core portion, and thereby the tip seal member, into the orifice in blocking, nonretractable position. U.S. Pat. No. 4,572,691 sets forth a pen-like instrument for dispensing correction fluid comprising an elongate housing, a bag of thin flexible polymeric film material containing correction fluid within a cavity in the housing, and an applicator tip assembly comprising a body secured to the housing and the bag and having a through opening through which the correction fluid is dispensed when an applicator member positioned within the through opening separated from a lip on the body against the bias of a spring. U.S. Pat. No. 4,600,327 discloses a writing instrument having an ink applicator at one end and a hollow cylindrical reservoir at the opposed end containing a correction fluid. A first cap member is removably received on the instrument to cover the ink applicator when not in use and a second cap member is removably received on the opposed end of the instrument to enclose the reservoir. A fluid applicator brush is secured in the second cap and has a depending portion which is removably received within the reservoir in a stored position when the second cap is in place. U.S. Pat. No. 4,812,071 provides a correction fluid pen for applying a correction fluid, the correction fluid being of the type containing an opaque covering pigment and a volatile solvent. The pen includes a barrel with a manually squeezable plastic wall portion and an applicator with a spring biased stylus. The squeezable plastic wall portions advantageously have a bellows structure to facilitate the manual squeezing operation. The stylus is positioned within an orifice assembly which includes an orifice for passing the correction fluid. A portion of the stylus is moveable toward an exit opening for the orifice assembly for metering correction fluid passing out of the orifice assembly. U.S. Pat. No. 4,917,521 describes a pen type dispenser structure attachable to a container for ink correction liquid. The dispenser includes a frusto-conical liner wall formed into a spiral configuration; a shaft extends from the small end of the liner wall into a liquid discharge opening formed in the tip end of a surrounding cover. A manually-squeezable lever is mounted on the container for rotating the cover. A wedge surface on the cover interior surface is slidably engaged with a wedge surface on the spiral liner wall, such that rotation of the cover causes the spiral liner to move the internal shaft away from the liquid discharge opening at the tip end of the cover. U.S. Pat. No. 4,923,317 teaches a brushless white-out correcting fluid applicator for use in applying white-out fluid to paper without using a brush. The white-out fluid is a suspension including a substantial proportion of white or substantially white particles, such as titanium dioxide, or other color particles. The applicator includes a wear-resistant, porous tip and a regulator between the tip and a reservoir. The regulator may be formed of foam material, and the tip may be of sturdy porous plastic. The size of the pores in the tip and regulator are large enough so that they do not become clogged with particles in the white-out fluid. The regulator prevents the tip from dripping by regulating the rate at which fluid can leave the reservoir. The size of the pores adjacent the reservoir may be different than the size of the pores and passageways adjacent the tip. The applicator may be provided with an air-tight cap to avoid drying out between uses. Alternative embodiments of the applicator include a foam tip with a nylon mesh outer covering for wear resistance; and an internal, pressure actuated valve may be included to regulate the flow of the white-out suspension to the tip. U.S. Pat. No. 5,056,949 sets forth a correction fluid dispenser comprising a body member adapted to retain a correction fluid and a barrel disposed at one end thereof for delivery of the fluid to a surface. The barrel terminates in an orifice formed by a circular rim with a spherical ball of greater diameter disposed at the orifice. The ball is supported by a socket member, the ball and socket means being spring biased toward the orifice. A stop means is provided to prevent the ball from extending entirely within the rim of the orifice. U.S. Pat. No. 5,123,766 discloses a dispensing pen includes a cylindrical body formed with a conically tapered forward end, with the forward end including a spherical or brush applicator. The cylindrical body includes an end cap threadedly mounted thereon, with the end cap housing a piston, with the piston biased within the cylindrical body to effect pressurizing of a fluid reservoir contained within the cylindrical body to direct such fluid through the applicator brush or spherical member of the applicator. The pressurizing piston mounted within the end cap includes a biasing means and a regulator to maintain pressurizing of the fluid, wherein alternatively, the piston includes a piston body that is externally threaded mounted within an internally threaded interior wall of the end cap to effect pressurizing of the reservoir. U.S. Pat. No. 5,261,755 provides a dispenser for depositing a liquid correction fluid onto a print medium is formed of an elongated tubular body having a valve means at one end and closed at the opposite end for retaining the fluid therein. The tubular body is substantially circular in cross-section at either end and comprises an enlarged body portion of larger cross-section for squeezing the material from the body when the valve is in the open position. U.S. Pat. No. 5,338,123 describes a double-ended pen has a pair of elongated liquid-holding reservoirs each having a rear end, a front end having a liquid-applying tip, an intermediate portion between the ends and having at the rear end a predetermined relatively small outside diameter, and a snap-type retaining formation. An intermediate coupling sleeve has a pair of oppositely open seats each receiving a respective one of the rear ends and provided with formations for retaining the respective rear ends securely against axial displacement. The sleeve also has a pair of axially opposite ends having axially oppositely directed end surfaces each having a portion extending at an acute angle to a plane perpendicular to the axis. The sleeve ends are of a diameter greater than the outside diameter of the intermediate portions and projecting radially there past when the respective rear ends are fitted in the seats. A pair of respective caps each adapted to fit over a respective one of the reservoirs each have a rear end substantially of the same diameter as the respective rear end of the sleeve and having an end surface with a surface portion complementary to the inclined portion of the respective sleeve end surface and engageable flush and complementarily therewith in a mounted position of the cap on the respective reservoir. Each cap further has an internal snap-type retaining formation complementary to and engaged with the snap-type retaining formation of the respective reservoir in the mounted position of the cap. U.S. Pat. No. 5,746,529 teaches a container for a free-flowing product, in particular typographic correction fluid, includes a tubular neck with an application aperture with a valve closure or the controlled application of metered quantities of the fluid to a substrate. The container remains, over an extended period, perfectly capable not only of applying spots of fluid precisely at a given point but also of applying the fluid over large areas. This is achieved by fitting the container with a second tubular neck with a second aperture and fitted with a removable closure cap with an integral applicator brush. Both tubular necks are disposed in the upper part of the container in such a way that the far end of the tubular neck with the application aperture projects out beyond the cap when the cap is in place over the second aperture. U.S. Pat. No. 5,915,872 sets forth a correction pen has a joining mechanism for joining together a front end portion of a barrel, and a coupling portion of a head member. The joining mechanism is constructed so that an inner cylindrical portion is pressed in a first coupling section, an annular bead formed on an outer cylindrical portion squeezes a second coupling section, and a bead formed on a step is pressed against the front end surface of the first coupling section when an annular ridge formed on the second coupling section is fitted in an annular groove formed in the outer cylindrical portion. A ball holding tube is provided with a ball housing bore and a connecting bore formed so that a low step is formed between the ball housing bore and the connecting bore. The edge of the tip of the ball holding tube is rounded. A head member is provided with a spring support portion for supporting a coil spring, provided with slots. A cap releasing member for releasing a cap put on a head portion of a barrel assembly has operating portions disposed on the side surface of the cap so as to be in contact with an inclined portion of the head member. U.S. design Pat. No. 319,469 is a shows the outer features of a correction fluid dispensing instrument. U.S. design Pat. No. 321,717 is shows the outer features of a combined ball-point pen and correction fluid applicator.

While the prior art thus contains many writing instruments which have been contrived to assist the writer with convenient means for correcting written errors using a correction fluid, none of these devices in the prior art are without shortcomings, either from an aesthetic or a functional standpoint. For example, most if not all writing instruments comprising a correction fluid reservoir must be diligently cleaned and maintained, lest nuisance amounts of dried residual correction fluid build up at critical dispensing or other areas, rendering such writing instruments to be less functional in their erasing capability or encrusted with unsightly white solid matter which is a nuisance, and which may smear and may stain clothes, or otherwise be difficult to remove from interior furnishings. In addition, the volatile chemicals within commercial correction fluids are known to cause health problems when chronically inhaled.

Another means devised for assisting a writer with correcting errors made when using a relatively indelible substance such as an ink is the use of what has become widely recognized in the art as "correction tape". In general terms, correction tape is a tape product which is designed to be applied over a written error, in order to mask the error. Typically, correction tapes are selected to comprise a color which matches the color of the background substrate upon which the writings are set forth. Typically, it has been found most convenient in the art thus far to provide correction tape in the form of a hand-held cassette or magazine type dispenser having an applicator portion which is contacted with the paper and moved slowly across an error by the user to cause an effective correcting amount of the tape to be dispensed over the error. Correction tape dispensers, compared to correction fluids, are very neat and clean to use and do not expose the user to hazardous vapors. The prior art contains many devices useful for dispensing correction tape, the following of which, all being herein incorporated by reference, are exemplary thereof: U.S. Pat. No. 5,310,437 teaches a hand operated device for transferring an adhesive film from a carrier tape to a substrate is provided with a single spool having a portion containing the roll of carrier tape and a large diameter portion having a plurality of knurls formed on the circumference thereof The tape is fed from the spool to contact the substrate and then fed between the knurls. A spring arm serves as a clutch by maintaining the tape in contact with the knurls but allowing slippage of the tape therebetween at a predetermined tape tension. U.S. Pat. No. 5,393,368 describes a correction tape dispenser comprising a tape comprising a carrier ribbon with correction composition thereon, supply and take-up spools for the tape, a tip having an edge for pressing the tape against a surface, a portion of the tape between the supply and take-up spools being guided to extend around said edge, wherein the edge is inclined to a feed direction which is the direction of travel of the tape leaving the supply spool, and the tip includes guide means on either side of the edge which operate in conjunction with the shape of the tip for twisting the tape so that the path of the tape around the edge between the guide means is in a plane substantially perpendicular to said edge and inclined to the feed direction. U.S. Pat. No. 5,714,035 discloses a correction tape dispenser body having an applicator tip assembly connected thereto, the assembly including an applicator tip with an edge for pressing a tape against a surface. The tip is connected to a supporting member by a shell bearing to permit relative movement between the tip and the supporting member, about a common axis. U.S. Pat. No. 5,820,728 provides a tape dispenser for applying a strip of a coating composition to a substrate, including a holder containing a supply spool of tape consisting of a carrier ribbon coated on one side with the composition, and a take-up spool for used tape consisting of carrier ribbon from which the composition has been removed. The tape is guided to pass between the supply and take-up spools around an edge of an application tip element used to press the ribbon against the substrate to transfer the composition onto the substrate. The application tip element is coupled to the holder for movement about a predetermined axis substantially aligned with the direction in which the element is pressed against the substrate in use of the dispenser. U.S. Pat. No. 6,112,796 sets forth a tape dispenser having a housing accommodating a tape. The tape consists of a carrier ribbon carrying a coating of a composition. The housing also accommodates used carrier ribbon from which the composition has been removed. The supply of tape is held in an elongated reel wound around a pair of spaced and independently rotatable spool members. Ends of the carrier ribbon are connected together, and the used carrier ribbon is stored on the reel with remaining unused tape.

While the prior art thus contains many different correction tape dispensers, it is devoid of any device which is a single article of commerce which comprises both a means for dispensing a correction tape and a means for writing characters, i.e., the prior art contains no writing instrument which further comprises a means for applying a correction tape to a substrate upon which characters are written. Thus, when using a correction tape dispenser according to the prior art to correct an error, a person who dominantly uses one hand more than the other must first put down their writing instrument, locate the correction tape dispenser, take the correction tape dispenser in their hand, apply the correction tape to the error, and then once again grasp the writing instrument and begin writing again. These series of events represent a great deal of wasted motion and effort, which are alleviated through use of a device according to the present invention.

SUMMARY OF THE INVENTION

The present invention is directed at a writing instrument with which a writer may dispense written characters on a substrate such as a piece of paper or the like. The writing instrument is preferably, but not necessarily, substantially linear in configuration, as in the case of nearly all writing instruments in popular use in modern times. Thus, a writing instrument according to the invention comprises a first end portion and a second end portion. The first end portion includes a writing end from which a relatively indelible substance such as an ink, whether oil-based or water based, may be dispensed onto a paper or other substrate in the form of written characters by the person using the writing instrument (the "user").

A writing instrument according to the invention further comprises a second end portion which includes a means for correcting erroneous dispensations of characters ("mistakes") written with the ink from the paper or other such substrate, wherein the means for correcting mistakes includes a means for dispensing a correction tape over such mistakes. Thus, unlike the prior art, the present invention permits a writer who makes an error to merely invert their writing instrument, apply an effective amount of a correction tape to such error, and re-invert their writing instrument back to the original position to resume writing. Through the use of the present invention, a great deal of effort can be saved, while further reducing the probability of not being able to locate the correction tape dispenser, since according to the invention the dispenser is an integral part of the writing instrument.

BRIEF DESCRIPTION OF DRAWINGS

In the annexed drawing.

DETAILED DESCRIPTION

Figure 1:
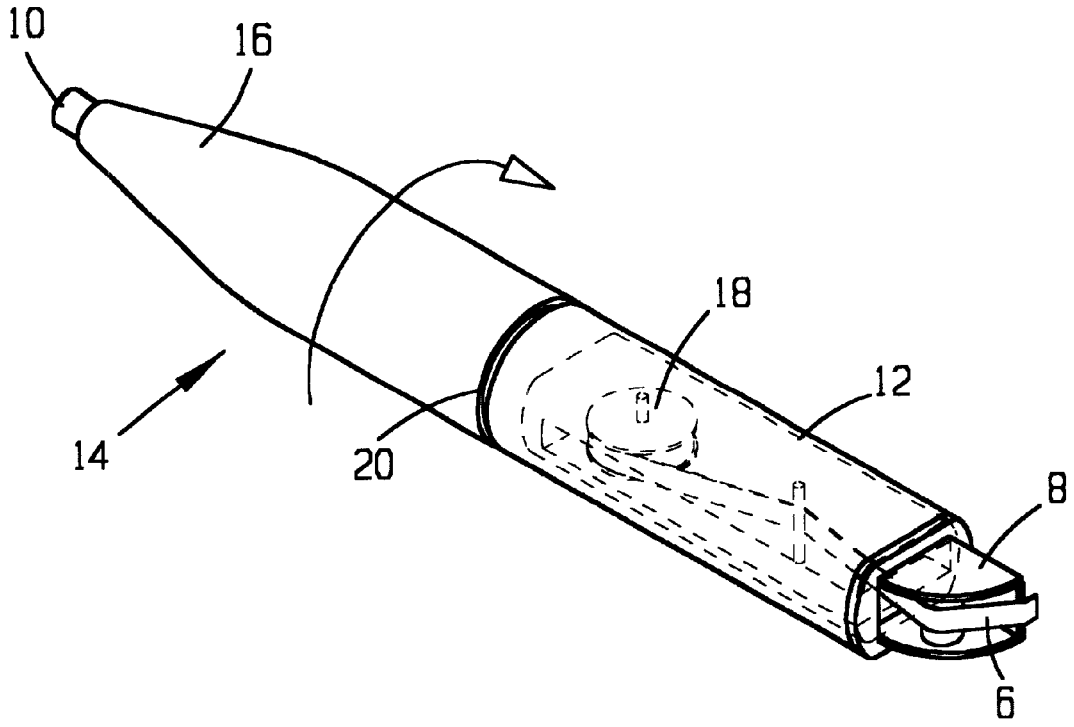
FIG. 1 shows a perspective view of a writing instrument according to the invention.

Referring initially to FIG. 1 there is shown a perspective view of a writing instrument according to the present invention 14. From the figure, it is clear that a writing instrument according to the invention, like most writing instruments in popular. usage, is substantially linear in shape, and comprises a first end portion 16 and a second end portion 12. The first end portion 16 comprises a writing end from which written characters may be written onto a substrate by a user. In one preferred form of the invention, the first end portion includes a writing end 10 which is an inkpen, from which a user may write characters in ink, as the use of inkpens. are commonly well known in the art. In another form of the invention, the writing end portion 10 may comprise a graphitic writing tip, such as a pencil. It is most preferred, however, that the writing end portion 10 comprises an inkpen, which inkpen is made retractable or extendable from within the writing device by a twisting of the outer casing portions of a writing instrument according to the invention which include the first end portion 16 and the second end portion 12 about the seam portion 20 about the longitudinal axis of the instrument, as such retractable pens and pencils are well known to those skilled in the art.

At the second end portion 12 of the writing instrument 14 there is disposed a means for correcting erroneous dispensations of written characters on a commonly used substrate, such as a paper substrate. In a preferred form of the invention, the means for correcting erroneous dispensations includes a means for dispensing a correction tape, which typically comprises a reel 18 of a correction tape 6 disposed in contact with a suitable carrier tape that is routed over an arrangement comprising a pulley and suitable guides, the use of which are all well known in the art of correction tape dispensations. Any known means for dispensing a correction tape may be used on the second end portion of a writing instrument according to the invention, whether the present invention is used to correct errors or to highlight text. In actual use during the correction of an error, an effective amount of correction tape is caused to mask the error by contacting the dispensing tip portion 8 with the paper or other substrate and gently moving the dispensing tip over the error to dispense the correction tape, as such motion and its effects are well-known to those skilled in the art. In an alternative form of the invention, the correction tape 6 is replaced by a transparent highlighter tape, that is, instead of there being a translucent correction tape disposed on a carrier tape to be used to block out errors, there is a transparent colored tape which may be applied over selected text in order to highlight the text over which the highlighting tape is placed, analogously to the way in which a correction tape is placed over erroneous characters.

It is most preferred that the means for dispensing correction tape is an integral part of the construct of the second end portion, although the present invention contemplates the use of a means for dispensing correction tape which is detachable from the writing end. One construct in which this is readily accomplished is in providing the outer shell of the device shown in FIG. 1 which lies to the right of the seam portion 20 to be removable from the remainder of the instrument, as such detachable end cap portions of inkpens having writing tips that are retractable by virtue of a twisting motion of the outer portions about a seam portion such as 20 are well-known in the art.

Although not shown in FIG. 1, the present invention further contemplates the use of a cap portion to be disposed over the dispensing tip portion 8, for purposes of protecting the dispensing tip portion from abrasions caused by typical movement of such an instrument during its normal storage and use.

The means for dispensing a correction tape disposed at the second end of a writing instrument according to the invention may be attached to the writing instrument in any one of several ways. First, it may be a separate construct which is caused to be in physical contact with the remainder of the writing instrument by means of conventional fasteners, such as snaps, hook and loop type fasteners, clips, wires, tongue and groove, screws, etc., including all prior art fasteners known useful for attaching various constructs to one another. In one preferred embodiment of the invention, the outer shell of the means for dispensing a correction tape is an integral portion of the portion of the writing instrument which lies to the right of seam 20 in FIG. 1, i.e., it is of a singular construction, as in the case of injection-molded plastics, which are well-known in the art as being useful in the manufacture of writing instruments. The actual materials of construction from which a writing instrument of the invention is made is of little consequence, provided the selection is one which provides for a rigid writing instrument. The preferred materials of construction include, without limitation, plastics, which are well known by those in the pen manufacturing arts as being suitable for pen manufacture, and metals Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow. All patent references cited herein are fully incorporated herein by reference thereto.

I claim:

1. A writing instrument with which a writer may dispense written characters on a substrate such as a piece of paper or the like which is equipped with a means for correcting errors, said writing instrument being substantially linear in configuration and comprising a first end portion and a second end portion, wherein said first end portion comprises a writing end from which written characters may be written onto a substrate by a user; and wherein said second end portion comprises a means for correcting erroneous dispensations of such characters on such substrate, wherein said means for correcting erroneous dispensations includes a means for dispensing a correction tape.

2. A writing instrument as in claim 1 wherein said first end portion comprises a graphitic writing tip.

3. A writing instrument as in claim 1 wherein said first end portion comprises an inkpen.

4. A writing instrument as in claim 1 wherein said means for dispensing a correction tape includes a reel upon which a correction tape is wound.

5. A writing instrument as in claim 1 wherein said means for dispensing a correction tape and said writing end are both integral elements of a single construction.

6. A writing instrument as in claim 1 wherein said means for dispensing a correction tape is detachable from said writing end.

7. A writing instrument as in claim 1 wherein the point at which correction tape is dispensable is located at a position disposed between 90 and 270 degrees from said writing end, including every degree therebetween.

8. A writing instrument as in claim 1 wherein the point at which correction tape is dispensable is located at a position disposed at about 180 degrees from said writing end.

9. A process for correcting a typographical error comprising the steps of:

a) providing a writing instrument as in claim 1;

b) providing a substrate upon which written characters may be caused to be disposed;

c) writing an erroneous character on said substrate;

d) inverting said writing instrument and causing an effective correcting amount of correction tape to be disposed over said erroneous character so as to effectively mask said erroneous character from the view of a reader;

e) re-inverting said writing instrument so that said writing end is in contact with said substrate; and f) writing the correct character upon said correction tape that was disposed over said erroneous character from step d).

10. A process as in claim 9 wherein said writing instrument never leaves the hand of the user.

11. A process as in claim 9 wherein the color of said correction tape substantially matches the color of said substrate.

12. A process as in claim 9 wherein said substrate is paper.

13. A writing instrument with which a writer may dispense written characters on a substrate such as a piece of paper or the like which is equipped with a means for highlighting text, said writing instrument being substantially linear in configuration and comprising a first end portion and a second end portion, wherein said first end portion comprises a writing end from which written characters may be written onto a substrate by a user; and wherein said second end portion comprises a means for highlighting characters on such substrate, wherein said means for highlighting includes a means for dispensing a tape.

* * * * *